US006889438B2

(12) United States Patent
Brown et al.

(10) Patent No.: US 6,889,438 B2
(45) **Date of Patent: *May 10, 2005**

(54) OVAL FRAME RAZOR

(75) Inventors: Frank Edward Brown, Maidenhead (GB); Brian Oldroyd, Reading (GB)

(73) Assignee: The Gillette Company, Boston, MA (US)

( * ) Notice: Subject to any disclaimer, the term of this patent is extended or adjusted under 35 U.S.C. 154(b) by 102 days.

This patent is subject to a terminal disclaimer.

(21) Appl. No.: 10/653,862

(22) Filed: Sep. 3, 2003

(65) Prior Publication Data

US 2004/0226172 A1 Nov. 18, 2004

Related U.S. Application Data

(63) Continuation of application No. 09/774,044, filed on Jan. 26, 2001, now abandoned, which is a continuation of application No. 09/063,842, filed on Apr. 21, 1998, now Pat. No. 6,185,823, which is a continuation of application No. PCT/US96/18192, filed on Nov. 8, 1996.

(30) Foreign Application Priority Data

Nov. 10, 1995 (GB) ..... 9523040

(51) Int. Cl.[7] ..... B26B 21/00

(52) U.S. Cl. ..... 30/50; 30/84; 30/76; 30/77

(58) Field of Search ..... 30/77, 41, 50, 30/49, 47, 34.2, 41.5, 74.1, 78, 79, 84; D28/47, 1

(56) References Cited

U.S. PATENT DOCUMENTS

| | | | |
|---|---|---|---|
| 330,418 | A | 11/1885 | Partridge et al. |
| 951,036 | A | 3/1910 | Waterman |
| 1,035,308 | A | 8/1912 | Boulter |
| 1,342,028 | A | 6/1920 | Nordskog |

(Continued)

FOREIGN PATENT DOCUMENTS

| | | |
|---|---|---|
| BE | 509-715 | 3/1952 |
| DE | 319632 | 3/1920 |
| DE | 319 832 | 4/1920 |

(Continued)

OTHER PUBLICATIONS

PCT Search Report dated Apr. 18, 1997 in corresponding PCT International application PCT/US96/18192 with examiner's indication of relevance of its foreign reference in English.

Picture of Wilkinson "Classic" (TM) Razor alleged circa 1980's, side view in exhibit numbered K9 to Nullity proceeding of Wilkinson in the matter of European patent EP 0 868 267 B1 (1 page).

(Continued)

*Primary Examiner*—Kenneth E. Peterson
*Assistant Examiner*—Omar Flores-Sánchez
(74) *Attorney, Agent, or Firm*—Edward S. Podszus

(57) ABSTRACT

A safety shaving assembly for attachment to a razor handle has optimised shape and dimensions for body shaving, especially the regions of the underarm. The shaving assembly has an elongate blade with a linear sharpened edge, and a skin contacting surface whose length is 1 to 4 times the width, preferably 1 to 2.8 times the width, has a large footprint area of at least 450 $mm^2$, preferably at least 600 $mm^2$, and a circularity (as herein defined to relate the area enclosed by the perimeter to the length of the perimeter) of not less than 70%. The shaving assembly is substantially inflexible over a major longitudinal dimension in use. In preferred embodiments the circularity is about 80%. A preferred shape is an oval resembling a rectangle with semi-circular ends. The forward and rearward skin-engaging surfaces in front of and behind the blade edge each can have a skin contact area of at least 140 $mm^2$, and their combined areas is preferably at least 400 $mm^2$. In preferred embodiments of the invention the length is not greater than 60 mm.

52 Claims, 10 Drawing Sheets

U.S. PATENT DOCUMENTS

| | | | | |
|---|---|---|---|---|
| 1,382,301 | A | 6/1921 | McCaffrey | |
| 1,642,338 | A | 9/1927 | Holtzman | |
| 1,690,557 | A | 11/1928 | Smith | |
| 1,744,280 | A | 1/1930 | Peterson | |
| 1,768,307 | A | 6/1930 | Bleloch et al. | |
| 1,798,447 | A | 3/1931 | Behrman | |
| 2,139,680 | A | 12/1938 | Heinrich | |
| 2,183,554 | A | 12/1939 | Evans | |
| 2,501,987 | A | 3/1950 | Brown | 30/32 |
| 2,547,376 | A | 4/1951 | Crawford | |
| 2,712,178 | A | 7/1955 | Marzio | |
| 3,477,127 | A | 11/1969 | Regan | |
| 3,724,070 | A | 4/1973 | Dorian, Jr. | |
| 3,783,510 | A | 1/1974 | Dawidowicz | 30/32 |
| 3,842,502 | A | 10/1974 | Hagan | 30/346.58 |
| 3,895,437 | A | 7/1975 | DiBuono | |
| 3,934,338 | A | 1/1976 | Braginetz | |
| 4,074,429 | A | 2/1978 | Roberts | |
| 4,208,791 | A | 6/1980 | Van Cleve | |
| 4,270,268 | A | 6/1981 | Jacobson | |
| 4,285,124 | A | 8/1981 | Diakanov | |
| 4,314,404 | A | 2/1982 | Ruiz et al. | |
| D271,531 | S | 11/1983 | Byrne | |
| 4,461,078 | A | 7/1984 | Carreker | |
| 4,562,644 | A | 1/1986 | Hitchens | |
| 4,712,300 | A | 12/1987 | Hemmeter | |
| 4,807,360 | A | 2/1989 | Cerier et al. | |
| 4,875,288 | A | 10/1989 | Trotta et al. | |
| 4,901,437 | A | 2/1990 | Iten | |
| 4,964,214 | A | 10/1990 | Welsh et al. | |
| 4,977,670 | A | 12/1990 | Iten | |
| 4,984,365 | A | 1/1991 | Leonard et al. | |
| 5,031,317 | A | 7/1991 | Jacobson | |
| 5,038,472 | A | 8/1991 | Iderosa | |
| 5,063,669 | A | 11/1991 | Althaus | |
| 5,084,968 | A | 2/1992 | Trotta | |
| 5,161,307 | A | 11/1992 | Althaus | |
| 5,191,712 | A | 3/1993 | Crook et al. | |
| 5,199,173 | A | 4/1993 | Hegemann et al. | |
| 5,208,982 | A | 5/1993 | Feruzza, Jr. | |
| 5,249,361 | A | 10/1993 | Apprille, Jr. et al. | |
| 5,295,305 | A | 3/1994 | Hahn et al. | |
| 5,313,706 | A | 5/1994 | Motta et al. | |
| 5,369,885 | A | 12/1994 | Ferraro | |
| 5,416,973 | A | 5/1995 | Brown et al. | |
| 5,463,813 | A | 11/1995 | Otsuka et al. | |
| 5,497,550 | A | 3/1996 | Trotta et al. | |
| 5,522,137 | A | 6/1996 | Andrews | |
| D373,218 | S | 8/1996 | Shurtleff et al. | |
| 5,557,851 | A | 9/1996 | Oritz | |
| 5,579,580 | A | 12/1996 | Althaus et al. | |
| 5,604,983 | A | 2/1997 | Simms et al. | |
| 5,689,883 | A | 11/1997 | Ortiz et al. | |
| D403,811 | S | 1/1999 | Brown et al. | |
| 5,903,979 | A | 5/1999 | Oldroyd | |
| D415,315 | S | 10/1999 | Swanson et al. | |
| 6,161,287 | A | 12/2000 | Swanson et al. | |
| 6,185,823 | B1 | 2/2001 | Brown et al. | |

FOREIGN PATENT DOCUMENTS

| | | |
|---|---|---|
| DE | 3733486 | 4/1989 |
| DE | 87 17 729.3 | 11/1989 |
| EP | 0 020 816 | 1/1981 |
| EP | 0 453 906 | 4/1991 |
| EP | 0 477 132 | 3/1992 |
| FR | 482 302 | 3/1917 |
| FR | 806 899 | 12/1936 |
| FR | 954 296 | 12/1949 |
| FR | 1503887 | 12/1967 |
| GB | 21940 | 9/1913 |
| GB | 409902 | 5/1934 |
| GB | 1157640 | 7/1969 |
| GB | 1 377 134 | 12/1974 |
| GB | 1 565 415 | 4/1980 |
| GB | 2 155 383 | 9/1985 |
| GB | 2200587 | 8/1988 |
| GB | 2 274 421 | 7/1994 |
| JP | 4-361783 | 12/1992 |
| WO | WO 91/01204 | 2/1991 |
| WO | WO 96/02369 | 2/1996 |

OTHER PUBLICATIONS

Picture of package rear panel of Wilkinson "Classic" razor purchased in Germany in Jun., 2004 resembling Classic razor in "BI" above and illustrating plastic guard seat formed with the handle, a removable blade, and removable screwed on plastic top cap. (1 page).

Draft Germany nullity request dated Jun. 14, 2004 relating to German registered patent from European EP 868 267 B1, p. 1 and selected paras. 43–49 discussing "Classic" razor. (4 pages).

English translation of portions of draft German nullity request, p. 1 and paras. 43–49. (3 pages).

Statement of Prof. W. Wehl summarizing measurements of "Classic" razor, in German. (4 pages).

English translation of Prof. Wehl statement. (4 pages).

Bic Lady Shaver in undated picture from Bicworld.com website visited Jun. 27, 2004 with Bic Product History Timeline reflecting a 1994 product date indicative of prior public use (1 page).

OVAL FRAME RAZOR

This application is a continuation application of U.S. application Ser. No. 08/774,044, filed Jan. 26, 2001, now abandoned, which is a continuation of U.S. application Ser. No. 09/063,842, filed Apr. 21, 1998, now U.S. Pat. No. 6,185,823, which is a continuation of PCT/US96/18192, filed Nov. 8, 1996.

BACKGROUND OF THE INVENTION

This invention relates to safety razors of the kind having a blade unit carried by a handle, the blade unit including an elongate blade with a rectilinear sharpened edge, or a plurality of such blades with parallel edges. The blade unit may be fixedly mounted on the handle with the intention that the entire razor be discarded when the blade edge or edges have become dulled. Alternatively, the blade unit can be detachably connected to the handle to enable replacement of a used blade unit with a fresh blade unit. Replaceable blade units are commonly referred to as cartridges.

SUMMARY OF THE INVENTION

There has been a general tendency over recent years for razor blade units to have been reduced in size, especially regarding the area of the surfaces which contact the skin around the blades during shaving, and the majority of blade units currently available in the marketplace are long and narrow with substantially rectangular configurations as viewed in a direction substantially perpendicular to the skin contacting surfaces. On the whole razor blade units of such shape and size have been found to provide an enhanced shaving performance in comparison with earlier blade units of larger dimensions.

The present invention is aimed specifically at a blade unit for body shaving, primarily in the axillary area. There are already on the market razors intended for use by ladies who do commonly shave their axillae, and like other razors there has been a strong trend towards making the blade units of these female razors with a narrow rectangular configuration as mentioned above. It has become the accepted thinking within the art that such blade units of narrow dimensions are especially beneficial for shaving the axillae since they will more readily fit into the rather deep concave socket of the axilla.

The present invention makes a significant departure from this current thinking in the shaving field and goes directly against all recent developments in this technical area as regards blade unit dimensions. Surprisingly, and contrary to all expectations, shaving tests have shown that not only can a blade unit of relatively large dimensions at least equal the shaving effectiveness of the smaller prior art blade units when shaving the axillae, but large blade units can be shaped to conform to the axilla region of the body so that shaving performance is not diminished, and that in terms of overall comfort large blade units have a superior performance to the prior art blade units and are preferred by users. It appears the added stability given by a large contact area with the skin gives the user greater confidence when shaving the axilla which cannot be viewed very easily during the shaving process, and as a consequence an improved comfort is perceived by the user and this more than counteracts any loss of performance due to the large contact area.

For most adult females, the underarm cavity has a minimum radius of curvature of about 25 to 30 mm. Therefore, a razor blade unit according to the invention has a length not greater than 60 mm, preferably not greater than 50 mm, and a length in the range of 40 to 45 mm is preferred. The width of the blade unit is preferably such that the aspect ratio, namely the ratio of the overall length to the overall width measured perpendicular to the blade, is in the range of 1 to 4, and in most of the preferred embodiments of the invention the aspect ratio is from 1.5 to 2.8, and more precisely in the range of 2.0 to 2.5. In the preferred embodiments the width of the blade unit is in the range of 12 to 23 mm, in particular 15 to 20 mm. Guard and cap surfaces are defined in front of and behind the blade or blades for contact with the skin in front of and behind the blade or blades during shaving, and preferably each of the guard and cap surfaces has a width of not less than 4.0 mm, at least where the width of the blade unit is at a maximum. The guard and cap each has a skin contact area which is preferably not less than 140 $mm^2$, and the combined skin contact areas of the cap and guard are preferably at least 400 $mm^2$, and most preferably in the range of 450 to 500 $mm^2$. As the blade unit of the present invention is rather wide, in order to facilitate contact with the skin in the axilla over at least most of the guard and cap areas, as viewed in cross section in a plane perpendicular to the blade edges, the skin contacting surface is made convex. It is important to understand that the word "convex" as used in the present specification does not necessarily mean that the skin contacting surface is smoothly curved and it implies only that the guard and cap surfaces extend upwardly in the direction from their edges remote from the blade or blades so that the blade edge or edges are at a level above the remote edges of the cap and guard surfaces. More particularly, a straight line joining the outer and inner limits of each of the guard and cap surfaces is inclined at an angle of at least 5°, and possibly up to 25°, to a plane which is tangential to the skin contacting surfaces immediately in front of and behind the blades. In the preferred embodiments the angle of inclination is in the range of 10 to 20 degrees, and more specifically substantially equal to 15°. By virtue of the convexity of the skin contacting surface, the blade unit is preferably shaped to make at least three point contact with an imaginary circumscribing circle having a diameter of from 30 to 100 mm, and preferably of about 50 mm whereby it will be ensured that the blade unit convexity will at least approximately conform to that of the axilla.

An important aspect of the blade unit according to the invention is that it defines a large area over which contact can be made with the skin during shaving, and a circumscribing perimeter extending about the skin contacting surface confines an area, referred to hereinafter as the "footprint area", of at least 450 $mm^2$. The most preferred footprint area is in the range of 600–750 $mm^2$, and more specifically between 650 and 720 $mm^2$.

Since the invention proposes a blade unit with a long and wide shape, a substantially rectangular configuration with sharp angled corners, at least at the edge adjacent the guard surface, is inappropriate. For the purposes of the present specification a sharp angled corner may be considered to be an angle less than about 120° with a radius of curvature less than around 3 mm. Preferably the curvature at any corner is at least 5 mm. The unacceptability of a substantially rectangular configuration and the objective of providing a large skin contact area means that the blade unit needs to be profiled, as seen in plan generally perpendicular to the skin contacting area, to obtain a relatively large area within the confines of the overall length and width dimensions. The "circularity" of a two dimensional shape is a convenient way of relating the area enclosed by its perimeter to the length of the perimeter, and expressing it in terms of a percentage compared with a circle which always provides the maximum area for any given perimeter length. Thus, the circularity for any shape is defined by the equation:

$$\text{Circularity} = \frac{A}{P^2} \times 4\pi \times 100$$

where

A=the area

P=the perimeter

Razor blade units according to the present invention have a circularity not less than the lower of (a) 65%, and (b) the circularity of a substantially rectangular area having the same length and width as the skin contacting area and having corner radii of 30% of said width. Preferably the circularity is greater than that of a rectangle with the same overall length and width and rounded corners with radii equal to 10% of the length. For blade units with a low aspect ratio, i.e. less than about 3, the lower limit (a) will apply, although even in the case of these blade units it is preferable that the circularity also exceeds limit (b). Acceptable oval blade units with an aspect ratio above 3.25 may have a circularity of less than 65%. Preferred embodiments with aspect ratios below about 2.75 have a circularity greater than 70%, and more particularly in the order of 80%. Typical prior art blade units have a circularity of less than 65%. The comparatively large circularity of a blade unit according to the invention can be achieved with rounded corners at the ends of the blade unit with relatively large radii of curvature of at least 6 mm, or with oval, elliptical or polygonal shapes which need not necessarily be symmetrical.

Having regard to the foregoing, the present invention resides in a razor blade unit comprising at least one elongate blade having a rectilinear sharpened edge and mounted in a substantially inflexible carrier, a skin contacting surface surrounding the blade edge(s) and including guard and cap surfaces on opposite sides of the blade edge(s), the aspect ratio of the length to width of the skin contacting surface being in the range of from 1 to 4, as seen in cross section in a plane perpendicular to the blade edge(s)—the skin contacting surface being convex, the overall length of the blade unit at the skin contacting surface being not greater than 60 mm, the skin contacting surface having a circumscribing perimeter confining a footprint area of at least 450 $mm^2$, and the circumscribing perimeter being so shaped that the footprint area confined by said perimeter has a circularity (as herein above defined) not less than the lower of (a) 65%, and (b) the circularity of a substantially rectangular area having the same length and width as the footprint area of the skin contacting surface and having corner radii of 30% of said width, and the edge of the blade unit adjacent the guard surface being free of sharp angled corners.

A razor equipped with a blade unit as described above has been found in shave tests to achieve a significantly improved overall performance in shaving the axilla and has also been found to be very effective in shaving other body areas, such as the legs.

It should be understood that unless otherwise stated, all dimensions and areas quoted herein are measured in a projected plane and as seen in plan view so the effect of the convex curvature of the skin contacting surface of the blade unit has not been taken into account in determining the relevant dimensional data.

BRIEF DESCRIPTION OF THE FIGURES

To further illustrate the invention some forms of razor blade unit shaped and dimensioned in accordance with the invention will now be described with reference to the accompanying drawings, in which.

DETAILED DESCRIPTION OF PREFERRED EMBODIMENTS

Figure 14:
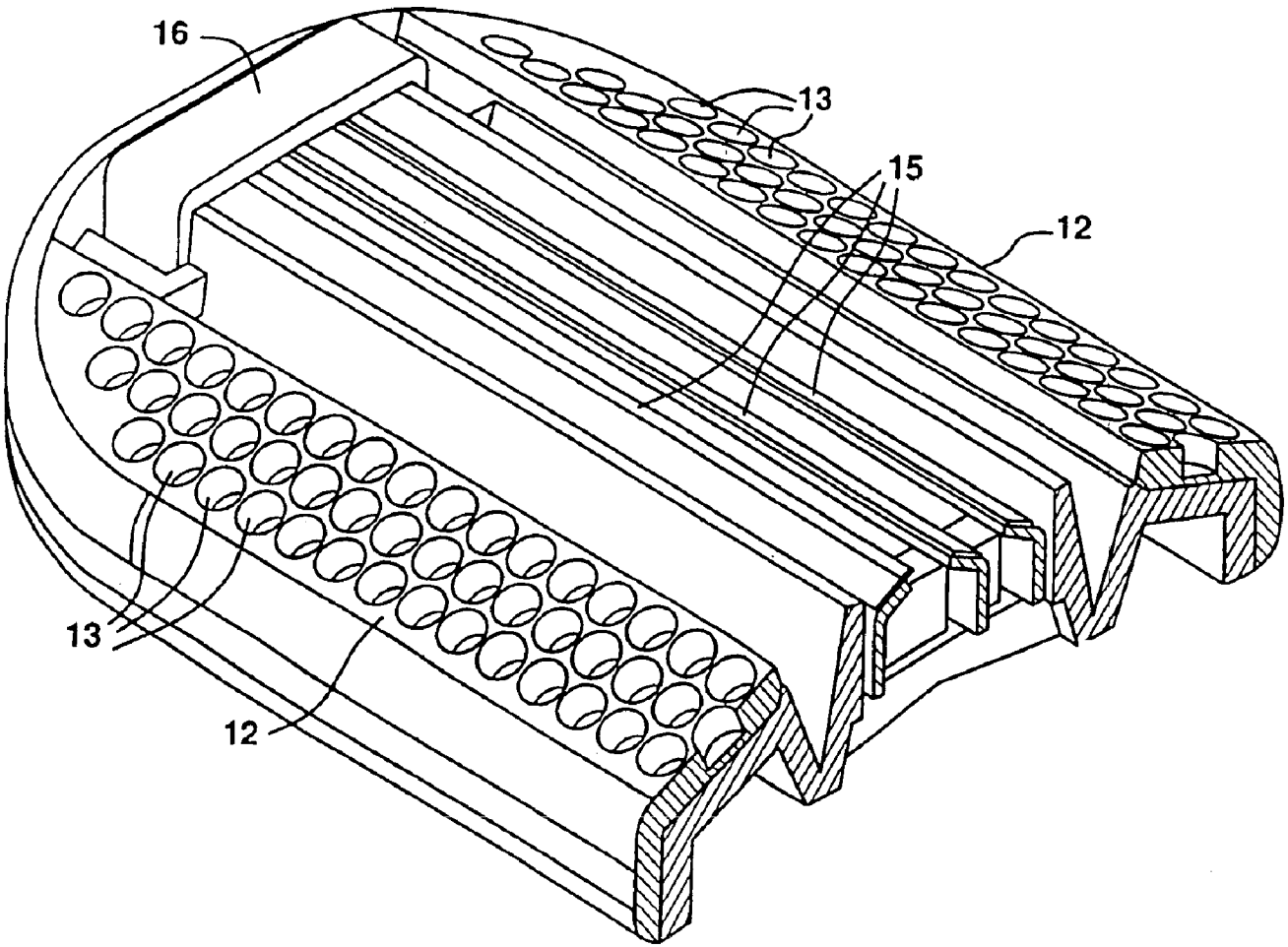
FIG. 14 illustrates in partial perspective view a blade unit as shown in FIG. 1 and having guard and cap surfaces similar to those of the FIG. 13 embodiment.
Figure 15:
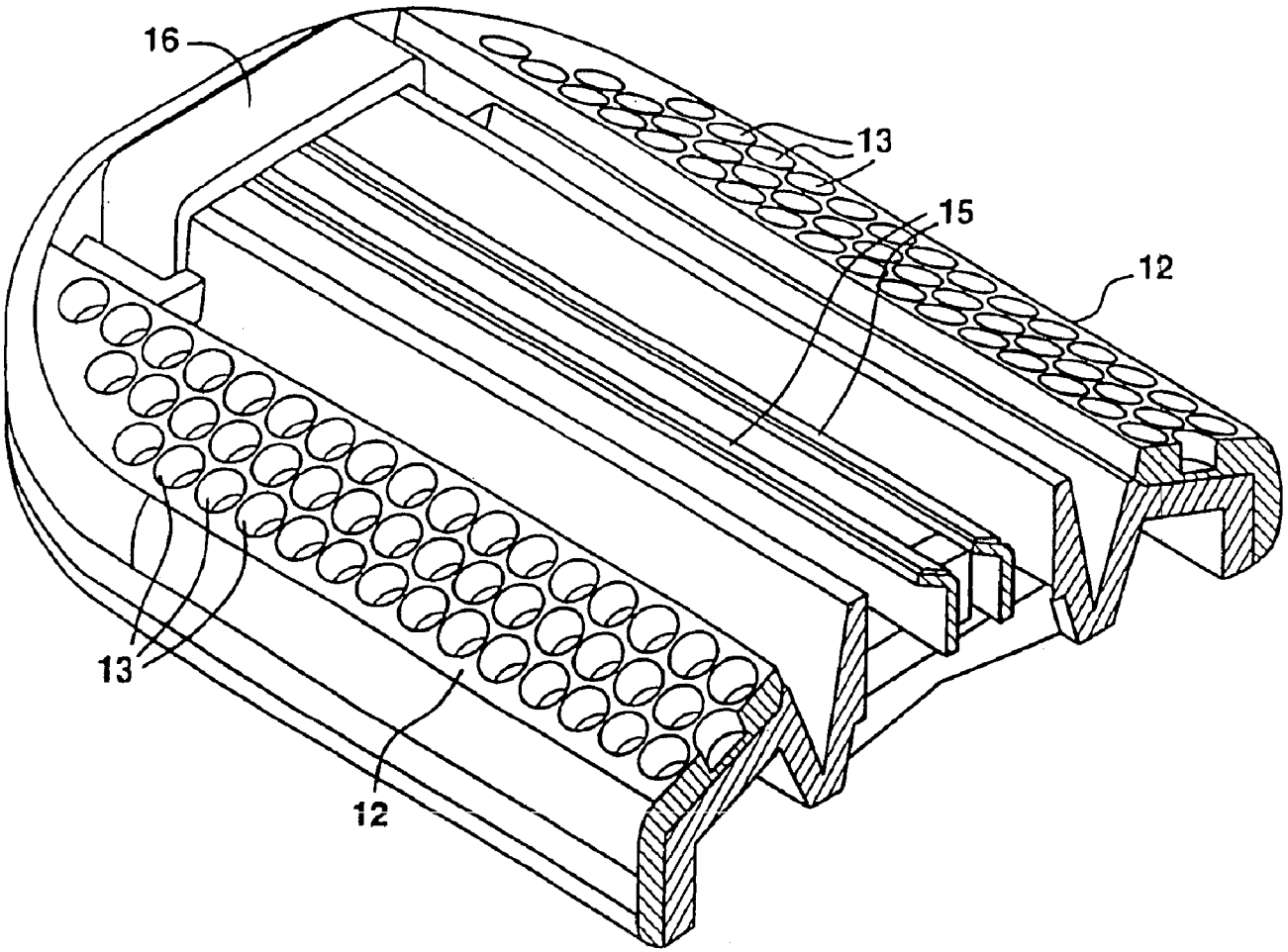
FIGS. 15 and 16 are views corresponding to FIG. 14 showing blade units with two and three forwardly facing blades, respectively.
Figure 16:
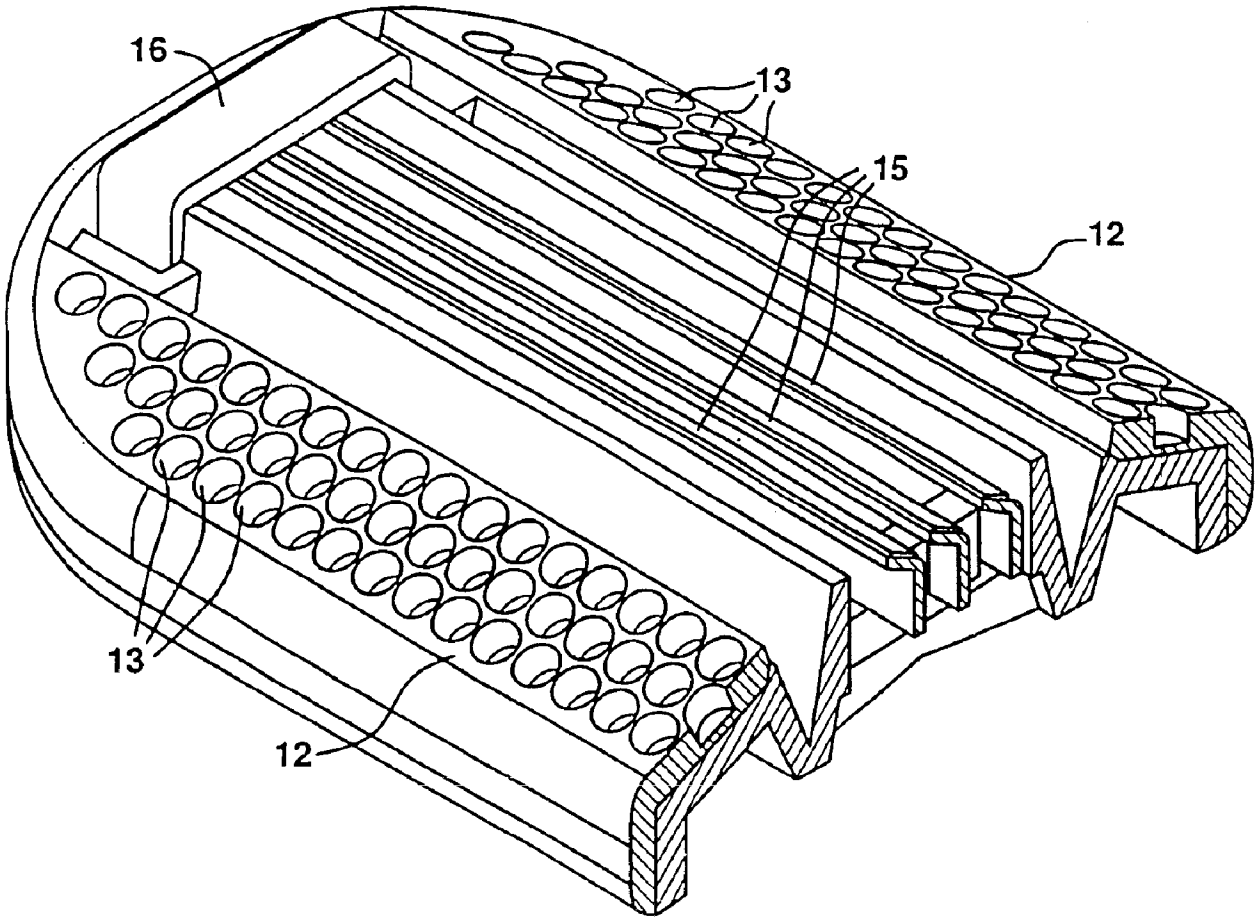
Figure 17:
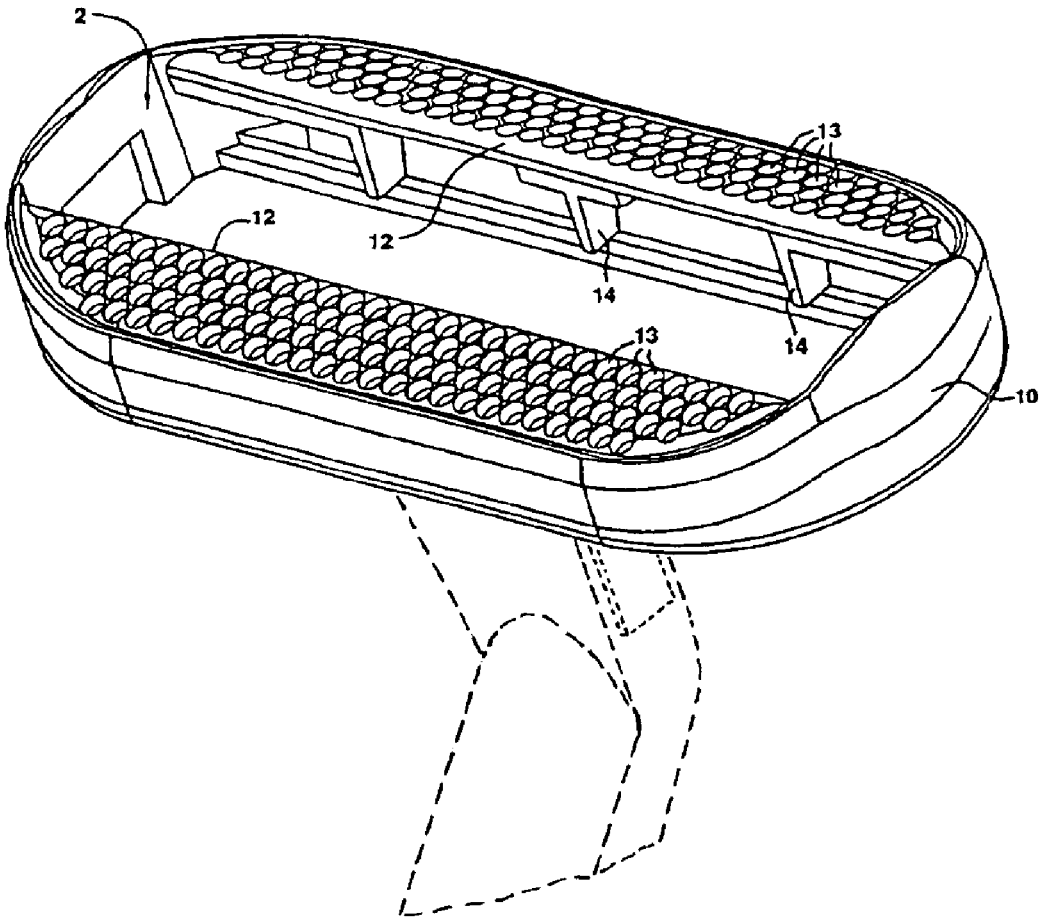
FIG. 17 represents a shaving assembly of FIG. 13 on a handle.

Each of the blade units shown in FIGS. 1 to 9 will comprise a blade housing which incorporates a substantially inflexible blade carrier frame conveniently moulded from plastics material. The housing defines a skin contact area surrounding an elongate rectangular aperture 2 in which a blade (not shown in FIGS. 1–9) with a sharp rectilinear edge is mounted. A single blade may be provided, but preferably two or more blades with parallel sharpened edges are mounted in the aperture 2. In the particular embodiment shown in FIG. 14, there are three blades, two facing forwardly and one facing rearwardly so that the razor blade unit will shave in both directions although forward movement across the skin will generally provide a slightly better result. FIG. 15 shows an embodiment with two blades in tandem, and FIG. 16 shows another embodiment with three blades with parallel edges all facing in the forward direction. Each of the blade units of FIGS. 1 to 9 may be regarded as being adapted to receive two blades, or three blades mounted similarly to the blades in FIG. 14 or all in tandem. The blade housing in each of the embodiments shown in FIGS. 1 to 9 has a guard area 3, which is located forwardly (below as viewed in the drawings) of the blade aperture, and a cap area 4 behind (above in the drawings) of the blade aperture 2.

Figure 1:
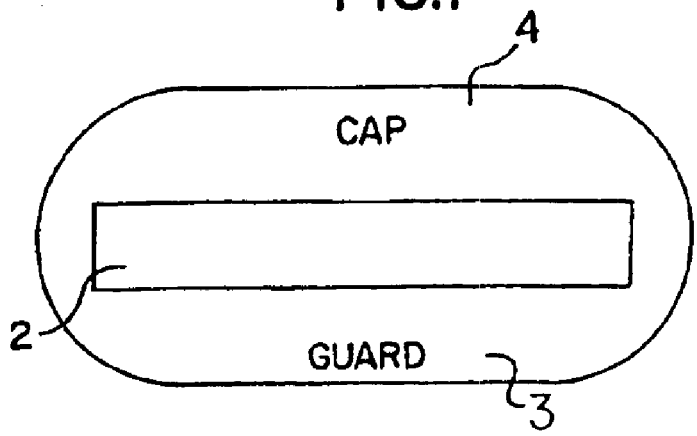
FIGS. 1 to 9 are schematic plan views of razor blade units embodying the invention.

The particular blade unit of FIG. 1 is oval and has the shape of a rectangle with semicircular ends. The dimensions as measured in the projected plan view as illustrated are as follows:

| | | |
|---|---|---|
| Overall length | = | 42.0 mm |
| Overall width | = | 18.0 mm |
| End radius | = | 9.0 mm |
| Guard area | = | 206 $mm^2$ |
| Cap area | = | 277 $mm^2$ |
| Total skin contact area | = | 504 $mm^2$ |
| Total footprint area within perimeter | = | 686 $mm^2$ |

Figure 2:
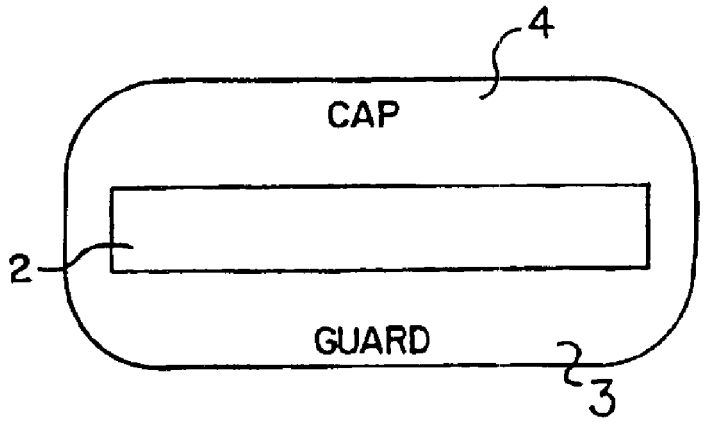

The blade unit of FIG. 2 is approximately rectangular with corners of large radii of curvature. The particular dimensions for this embodiment are:

| | | |
|---|---|---|
| Overall length | = | 41.0 mm |
| Overall width | = | 18.0 mm |
| Corner radius | = | 6.0 mm |
| Guard area | = | 213 $mm^2$ |
| Cap area | = | 286 $mm^2$ |
| Total skin contact area | = | 520 $mm^2$ |
| Total footprint area within perimeter | = | 703 $mm^2$ |

Figure 3:
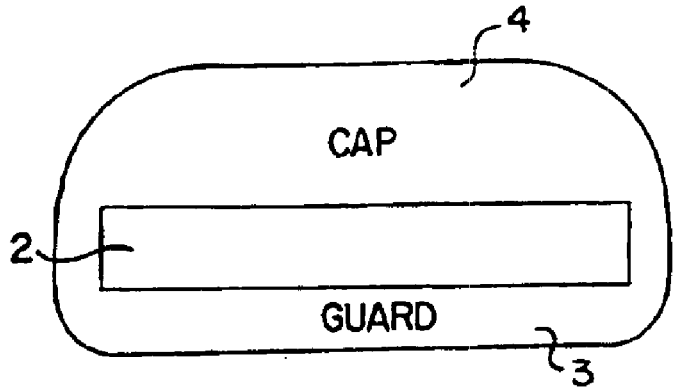

FIG. 3 illustrates a blade unit of asymmetric configuration. At the ends of the front edge of the blade unit housing are rounded corners of large radius (as in ~FIG. 2), and the corners at the ends of the rear edge are rounded with a substantially greater radius of curvature. The specific dimensions are:

| | | |
|---|---|---|
| Overall length | = | 40.0 mm |
| Overall width | = | 18.0 mm |
| Front end corner radius | = | 6.0 mm |
| Rear end radius | = | 10.0 mm |
| Guard area | = | 185 $mm^2$ |
| Cap area | = | 283 $mm^2$ |
| Total skin contact area | = | 488 $mm^2$ |
| Total footprint area within perimeter | = | 668 $mm^2$ |

Figure 4:
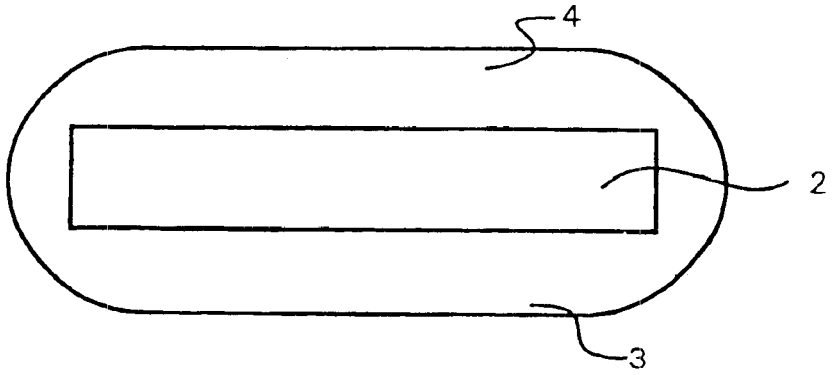
Figure 5:
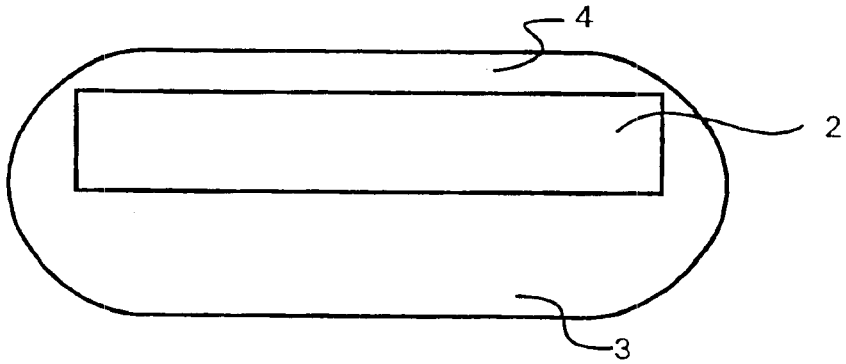
Figure 6:
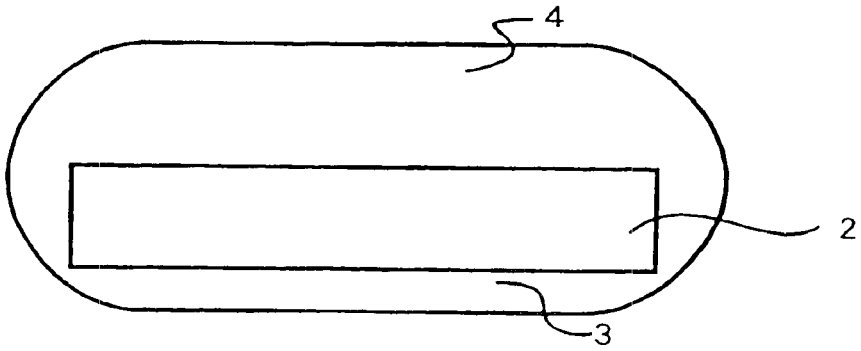

FIGS. 4–6 show blade units with housings of the same overall shape and size of that shown in FIG. 1, but the position of the blade aperture is different. In FIG. 4 the aperture is located so that the guard and cap areas are equal, whereas in FIG. 5 it is positioned so that the cap area is substantially smaller than the guard area (but still at least 140 $mm^2$) and in FIG. 6 it is positioned so that the guard area is substantially smaller than the cap area (but still at least 140 $mm^2$).

Figure 7:
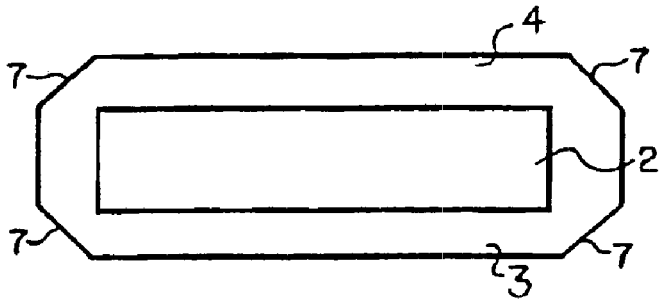

FIG. 7 illustrates a polygononal blade unit shaped essentially as a rectangle with chamfered corners 7 with faces at 135° to the longitudinal front and rear sides and to the ends. In the case of a blade unit of overall length 42 mm and overall width 18 mm, the chamfers may lie along the diagonals of squares measuring 5 mm×5 mm.

Figure 8:
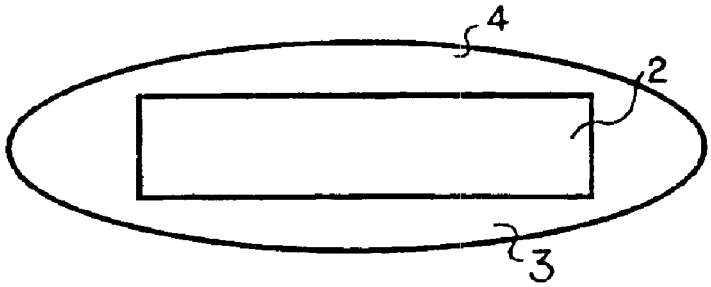
Figure 9:
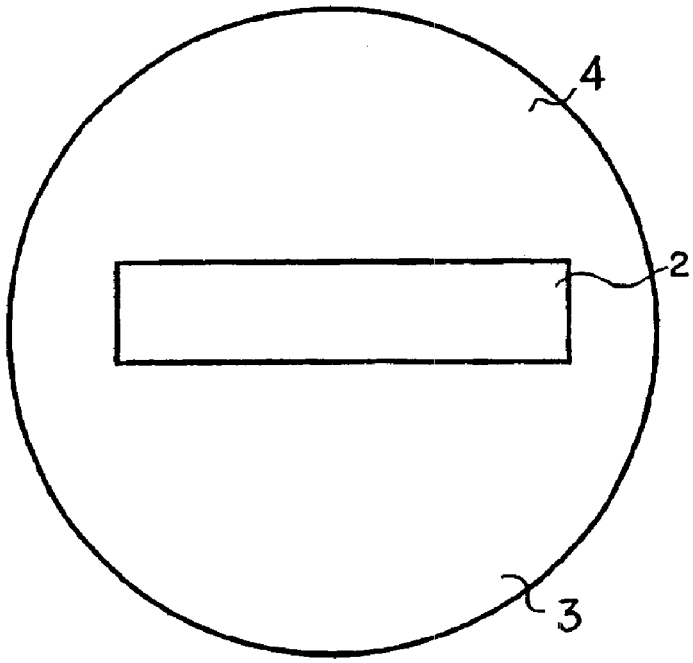

All the embodiments of FIGS. 1–7 have rectilinear front and rear edge portions which, at least over a major part of the blade length are parallel to the blade edge(s). This can be desirable to ease orientation of the blade unit and assist the user in knowing in which direction the blade unit should be moved over the skin. It is not essential, however, and the dimensional criteria of a blade unit embodying the invention can be obtained with other configurations. FIG. 8, for example shows a blade unit of elliptical outline, and even a circular shape as shown in FIG. 9 is possible although it is not the most desirable embodiment.

Figure 10:
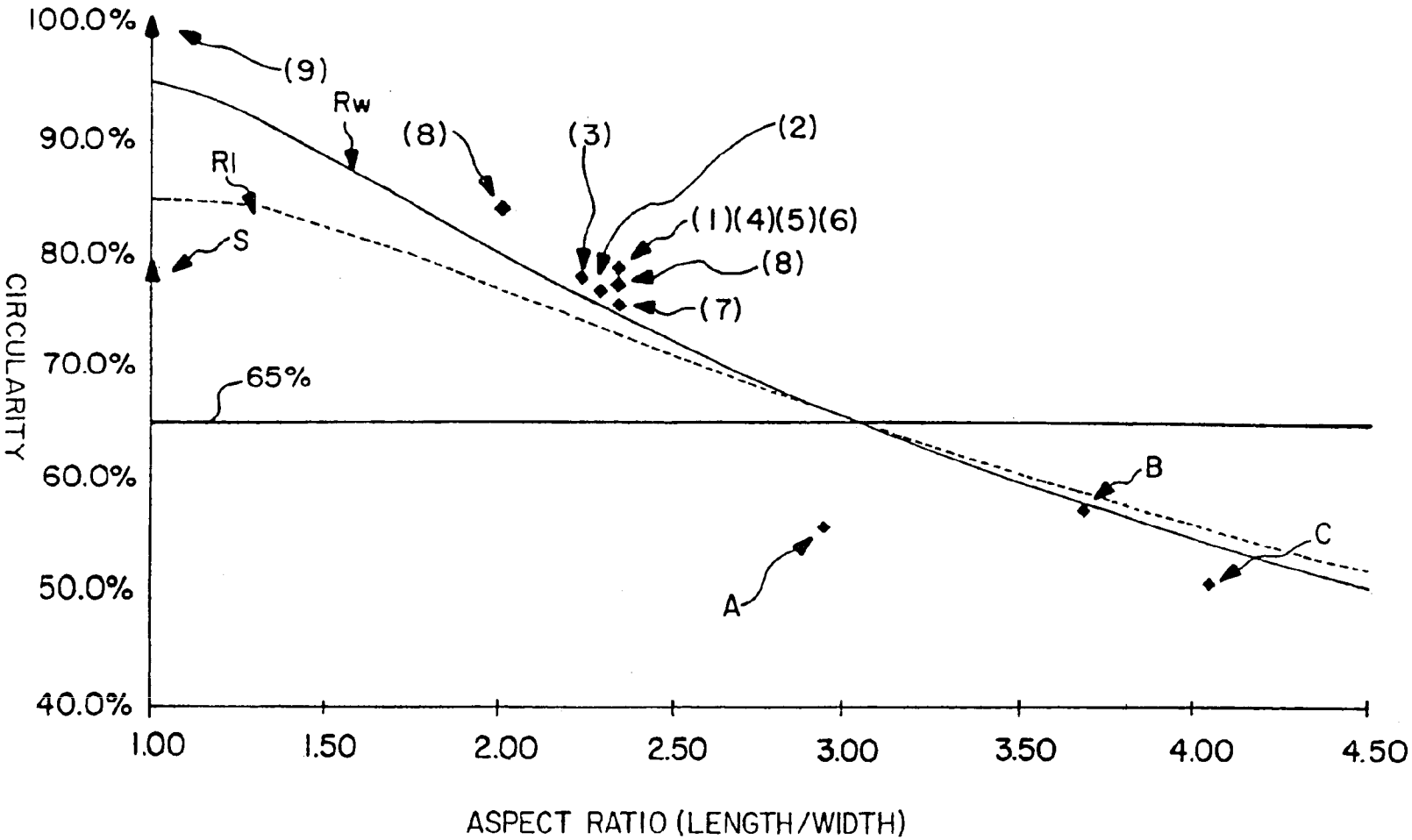
FIG. 10 is a graph showing circularity plotted against aspect ratio (maximum length/maximum width) and showing the results for the blade units of FIGS. 1 to 9 and for some prior art blade units.

FIG. 10 shows a graph showing circularity plotted against aspect ratio, i.e. the maximum length/maximum width of the blade unit. The points representative of the blade units of FIGS. 1–9 are indicated (1) . . . (9), the points representative of three prior art female razor blade units currently marketed are indicated A, B and C, and the point representative of a square is indicated S for comparison purposes. The line $R_W$ which extends generally diagonally across the graph is representative of rectangles with corner radii of 30% of the rectangle width. The dotted line $R_L$ is representative of rectangles with corner radii of 10% of the rectangle length. The horizontal line is drawn at a circularity of 65%. It can be seen that all the preferred embodiments of the invention denoted on the graph have aspect ratios between 1.5 and 2.8, and for the majority the aspect ratio is in the range of 2.0 to 2.5. Furthermore, the embodiments of the invention have circularity greater than the circularity of a corresponding rectangle with the same aspect ratio and having corners rounded at a radius of 10% of the rectangle length ($R_L$) or of 30% of the rectangle width ($R_W$). In addition, the embodiments of the invention have greater circularity than the prior art blade units and those included on the graph all have values above 60%, and more especially above 70%. (It may be noted that there are two points (8) shown in FIG. 10 to depict two alternative elliptical shapes).

Figure 11:
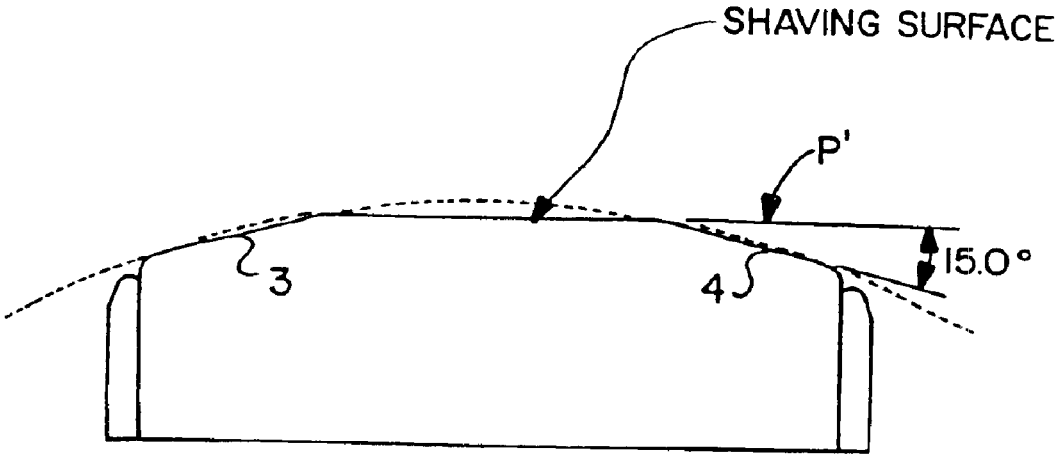
FIG. 11 is a schematic cross-section through the blade unit of FIG. 1.
Figure 12:
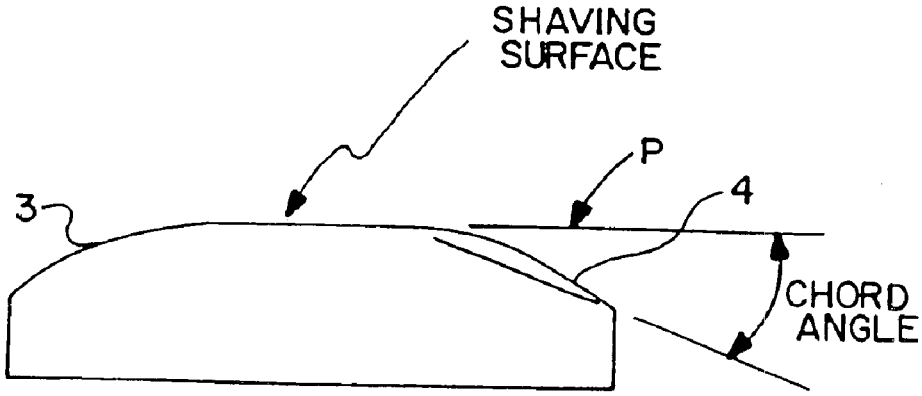
FIG. 12 illustrates a modified shape of guard and cap surfaces for the blade unit of FIG. 1.

In all of the embodiments of the invention the skin contacting surfaces are not flat and the views of FIGS. 1 to 9 are merely the projected plan areas. The surfaces are preferably shaped to make at least three point, and ideally at least four point contact with an imaginary circumscribing circle with a radius of 25 mm. FIG. 11 shows this preferred relationship for a blade which could, for example, be the blade unit of FIG. 1. The imaginary circle is drawn in dotted line, and it can be seen that the cap and guard surfaces are in substantial conformity with this circle. In FIG. 11 the guard and cap surfaces are essentially flat, but they could be convexly curved to provide even closer conformity, e.g. as depicted in the schematic illustration of FIG. 12. The cap and guard surfaces are inclined to a plane P, which is the "shaving surface" tangential to the skin contact surfaces immediately in front of and behind the blade(s), at an angle which is 15° in the exemplary embodiment illustrated. In any particular embodiment the most appropriate inclination angle will depend on the blade unit width and will be chosen accordingly, but for most embodiments of the invention at least, an angle in the range of 10° and 20° will be required to ensure close conformity with the imaginary circle. In the case of a convex guard and/or cap surface, as in FIG. 12, it will be appropriate to consider the inclination of a chord line intersecting the edges of the surface in question nearest and most remote from the adjacent blade.

Figure 13:
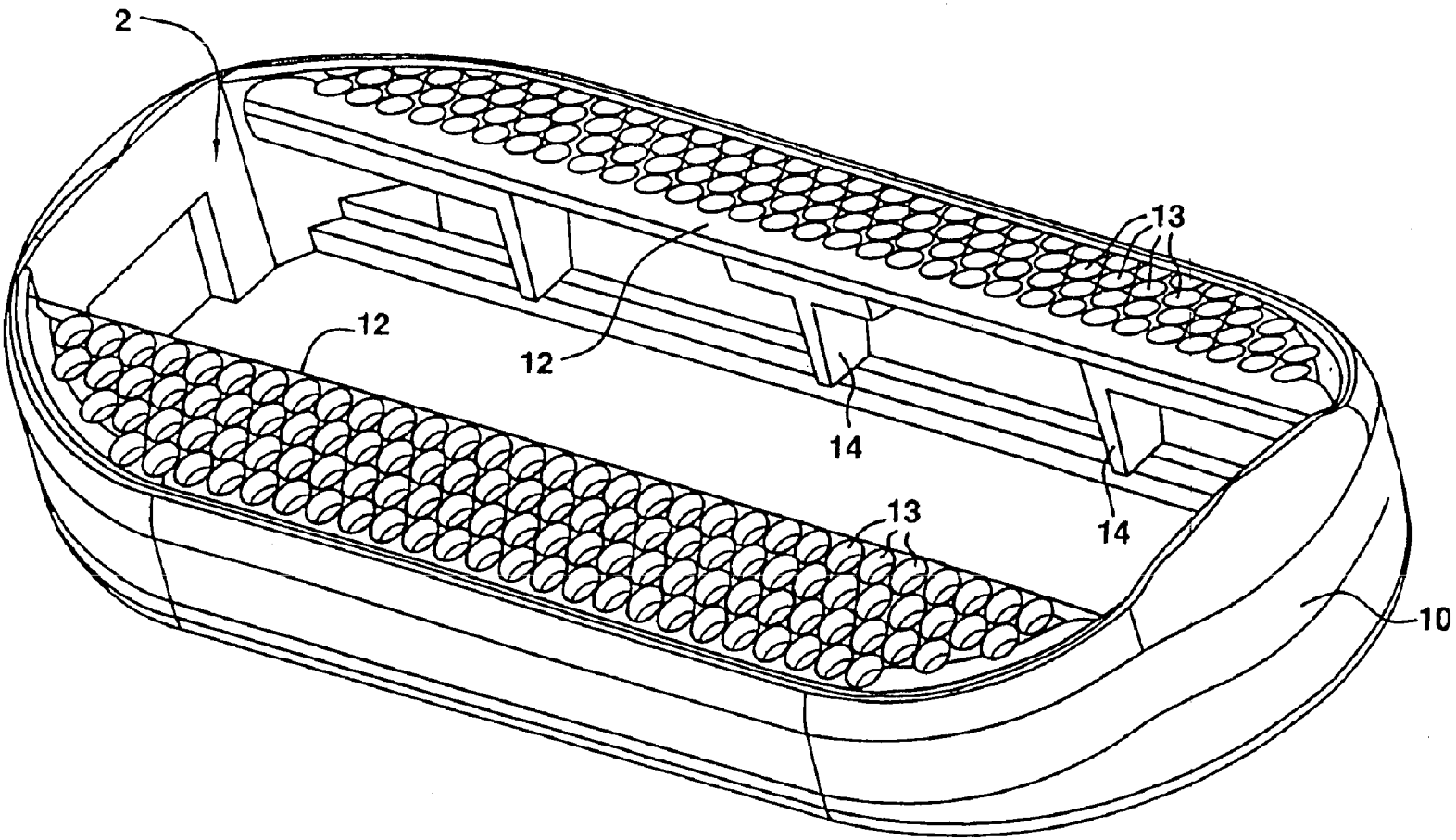
FIG. 13 illustrates in perspective a blade housing of a blade unit as shown in FIG. 1.

In FIG. 13 there is illustrated a preferred form of blade unit housing. It has a frame 10 defining an aperture 2 to accommodate the blades and the components which fix them in the frame. Mounted on the frame are guard and cap components each having an elastomeric surface element 12 defining a skin contact area formed with an array of cylindrical pockets 13 evenly distributed over essentially the entire surface area. For ease of manufacture and assembly the elastomeric element is moulded onto a support 14 which is firmly fastened in the frame 10. FIGS. 14, 15 and 16 show a modified construction wherein the elastomeric elements 12 are carried directly by the frame of the blade unit. These figures also shows the blades 15 fitted within the frames, and one of the securing clips 16 which are provided at each end of the blade unit to retain the blades in place.

It is important to note that, as previously mentioned, all the dimensions quoted in the description and claims of this specification regarding length, width and area are based on the profile of the blade unit skin contacting surface projected onto a plane which is parallel to the plane of the shaving surface i.e. the plane denoted P in FIG. 11. In addition, when calculating the circularity, any minor irregularities in the perimeter, e.g. due to small indentations, such as narrow notches or projections which can significantly change the perimeter without substantially changing the area, should be disregarded.

We claim:

1. A replaceable safety shaving assembly for attachment to a razor handle, comprising a plurality of elongate blades having longitudinally elongate, generally rectilinear sharpened edges and mounted in spaced relation in a carrier, said carrier comprising a molded material, a skin contacting surface surrounding the blade sharpened edges and including skin-engaging forward and rearward surfaces, the skin-engaging forward surface being in front and the skin-engaging rearward surface being at the rear of the shaving assembly, and the plurality of blades being located between the forward surface and the rearward surface and having the sharpened edges oriented in the same direction facing the forward surface such that during a shaving stroke the forward surface, the plurality of blade sharpened edges, and then the rearward surface contact the skin, the plurality of blades, said carrier and said skin-contacting forward and rearward surfaces being attachable as a unit to a said razor handle, the aspect ratio of the length to width of the skin contacting surface being in the range of from 1:1 to 2.8:1, said shaving assembly during shaving being substantially inflexible over a major longitudinal dimension, the skin contacting surface having a circumscribing perimeter confining a footprint area of at least 450 $mm^2$, the forward surface having an area of at least 140 $mm^2$ within the footprint area and being at least about 18.6% of said footprint area, and the circumscribing perimeter being so shaped that the footprint area confined by said perimeter has a circularity, wherein circularity (C) is a ratio between the area (A) of a shape enclosed by its perimeter (P) to the length of the perimeter as defined by the relation $C=A/P^2 4\pi 100$, not less than 70%.

2. A shaving assembly according to claim 1, wherein as seen in cross section in a plane perpendicular to the blade edges, at least one of the rearward and forward surfaces has, at a region proximal the plurality of blades, an upwardly facing portion that, in a direction towards an approximate plane intersecting the blade edges, is located above an outwardly facing peripheral edge portion that is located at a region remote from the plurality of blades.

3. A shaving assembly according to claim 1 in combination with a razor handle.

4. A shaving assembly according to claim 1, further comprising a clip retaining the plurality of blades to the carrier.

5. A shaving assembly according to claim 1, wherein the footprint area is oval and the front and rear edges of the shaving assembly each includes a generally rectilinear portion extending along a major part of the blade edge length and parallel thereto, and smoothly curved corner portions at either end of said generally rectilinear portion.

6. A shaving assembly according to claim 1, wherein the overall length at the skin contacting surface is not greater than 60 mm.

7. A shaving assembly according to claim 1, wherein the footprint area is at least 600 $mm^2$.

8. A shaving assembly according to claim 1, wherein the footprint area is between 600 and 750 $mm^2$.

9. A shaving assembly according to claim 1, wherein said aspect ratio of length to width is in the range of from 1.5 to 2.8.

10. A shaving assembly according to claim 1, wherein each of the forward and rearward surfaces has an area of at least 140 $mm^2$, and at a position where the width of the shaving assembly is greatest, each of the forward and rearward surfaces has a width of at least 4.0 mm.

11. A shaving assembly according to claim 1, wherein the maximum width of the shaving assembly is in the range of 12 to 23 mm.

12. A shaving assembly according to claim 1, wherein the combined area of the skin-engaging forward and rearward surfaces is at least 400 $mm^2$.

13. A shaving assembly according to claim 1, wherein a line segment constructed between inner and outer peripheral regions of at least one of said forward or rearward surfaces, the respective inner peripheral region being near to and the respective outer peripheral region being remote from the respective adjacent blade, is inclined downward to a plane tangential to the skin contacting surfaces immediately in front of and behind the blade edges at an angle of inclination.

14. A shaving assembly according to claim 13, wherein said angle of inclination is at least 5°.

15. A shaving assembly according to claim 14, wherein said angle of inclination is in the range of 10° to 20°.

16. A shaving assembly according to claim 1, wherein the skin contacting surface is shaped in cross-section to make at least three point contact with an imaginary circumscribing circle.

17. A shaving assembly according to claim 16, wherein the skin contacting surface is shaped for close conformity with said imaginary circle over the forward and rearward surfaces.

18. A shaving assembly according to claim 1, wherein each of the forward and rearward surfaces is shaped in lateral cross-section to make at least three point contact with an imaginary circumscribing circle.

19. A shaving assembly according to claim 1, wherein the area confined by the circumscribing perimeter of the skin contacting surface has a circularity in the range of 70% to 85%.

20. A shaving assembly according to claim 1, wherein the skin contacting surface has an elliptical profile.

21. A shaving assembly according to claim 1, wherein the plurality of blades comprises at least three blades mounted in the blade carrier.

22. A shaving assembly according to claim 21, wherein at least one said blade of said plurality of three blades faces an opposite direction from two said other blades.

23. A shaving assembly according to claim 1, wherein the rearward surface is disposed in spaced relation behind the carrier in which is mounted the plurality of blades.

24. A shaving assembly according to claim 1, wherein the forward surface is disposed in spaced relation forward of the carrier in which is mounted the plurality of blades.

25. A shaving assembly according to claim 1, wherein said carrier is substantially inflexible.

26. A shaving assembly according to claim 1, wherein the footprint area is oval.

27. A shaving assembly according to claim 1, wherein said forward and rearward surfaces each have respective outer and inner peripheral regions, the respective inner peripheral region being near to and the respective outer peripheral region being remote from the respective adjacent blade, and at least one of said forward and rearward surfaces extending upwardly in a direction from its respective outer peripheral region towards in respective inner peripheral region, whereby the respective adjacent blade is at a level above its respective outer peripheral region.

28. A shaving assembly according to claim 1, wherein an upwardly facing surface of at least one of the forward and rearward skin-engaging surface is planar.

29. A shaving assembly according to claim 1, wherein the forward and rearward skin-engaging surfaces are substantially planar.

30. A shaving assembly according to claim 1, wherein the aspect ratio is less than about 2.75 and the circularity is at least about 80%.

31. A shaving assembly according to claim 1 formed as a cartridge having handle-receiving mounting structure.

32. A shaving assembly according to claim 1, wherein the skin contacting surface is disposed on a frame (10) and wherein said frame defines a central aperture (2), said carrier and said plurality of blades being disposed in said central aperture.

33. A shaving assembly according to claim 32, wherein said carrier is formed separate from and connected to said frame.

34. A shaving assembly according to claim 32, wherein respective clips located at opposed ends of said aperture engage said carrier to said frame.

35. A shaving assembly according to claim 1, wherein the perimeter of the shaving assembly's skin contacting surface is free of sharp angled corners.

36. A shaving assembly according to claim 1, wherein the rearward surface's area is approximately the same as the forward surface's area.

37. A shaving assembly according to claim 1, wherein the rearward surface's area is larger than the forward surface's area.

38. A shaving assembly according to claim 1, wherein the skin contacting surface is approximately symmetric about a medial transverse plane.

39. A shaving assembly according to claim 1, wherein the forward surface's area is larger than the rearward surface's area.

40. A shaving assembly according to claim 1, wherein the carrier comprises a plastics material molding.

41. A shaving assembly according to claim 1, further comprising an elongate ledge molded of plastics material and disposed proximal a forwardmost said blade rectilinear sharpened edge between said forwardmost sharpened edge and said skin-engaging forward surface.

42. A shaving assembly according to claim 1 free of sharp angled corners along and adjacent the skin-engaging forward surface.

43. A shaving assembly according to claim 1, wherein the footprint area is oval and the front end rear edges of the shaving assembly each includes a generally rectilinear portion extending along a major part of the blade edge length and parallel thereto, and smoothly curved corner portions at either end of said generally rectilinear portion, wherein the footprint area is at least 600 $mm^2$, wherein said aspect ratio of length to width is in the range of from 1.5 to 2.8, wherein each of the forward and rearward surfaces has an area of at least 140 $mm^2$, and at a position where the width of the shaving assembly is greatest, each of the forward and rearward surfaces has a width of at least 4.0 mm, wherein the combined area of the skin-engaging forward and rearward surfaces is at least 400 $mm^2$, wherein the plurality of blades comprises three blades mounted in the blade carrier, wherein the aspect ratio is less than about 2.75 and the circularity is at least about 80%, wherein the skin contacting surface is disposed on a frame and wherein said frame defines a central aperture, said carrier and said plurality of blades being disposed in said central aperture, and said carrier is formed separate from and connected to said frame.

44. A shaving assembly according to claim 24, wherein the rearward surface is disposed in spaced relation behind the carrier in which is mounted the plurality of blades.

45. A shaving assembly according to claim 1, wherein at least one of the front and rear edges of the shaving assembly includes a generally rectilinear portion extending along a major part of the blade edge length and parallel thereto, and smoothly curved corner portions at either end of said generally rectilinear portion.

46. A shaving assembly according to claim 45, wherein said corner portions have a radius of curvature at least 6 mm.

47. A shaving assembly according to claim 45, wherein the shaving assembly has semi-circular ends.

48. A shaving assembly according to claim 1, further comprising an elongate ledge molded of plastics material and disposed proximal a rearwardmost said blade rectilinear sharpened edge between said rearwardmost sharpened edge and said skin-engaging rearward surface.

49. A shaving assembly according to claim 41, further comprising an elongate ledge molded of plastics material and disposed proximal a rearwardmost said blade rectilinear sharpened edge between said rearwardmost sharpened edge and said skin-engaging rearward surface.

50. A shaving assembly according to claim 1, wherein at least one of the plurality of blade edges is disposed above at least one of said forward and rearward surfaces.

51. A shaving assembly according to claim 50, wherein at least one of the plurality of blade edges is disposed above both said forward and rearward surfaces.

52. A shaving assembly according to claim 13, wherein the skin contacting surface is, in lateral cross-section, smoothly carved.

* * * * *

UNITED STATES PATENT AND TRADEMARK OFFICE

CERTIFICATE OF CORRECTION

PATENT NO. : 6,889,438 B2
DATED : May 10, 2005
INVENTOR(S) : Brown et al.

It is certified that error appears in the above-identified patent and that said Letters Patent is hereby corrected as shown below:

Column 8,
Line 62, change “in” to -- its --.

Column 9,
Line 46, change “end” to -- and --.

Signed and Sealed this

Thirtieth Day of August, 2005

JON W. DUDAS
*Director of the United States Patent and Trademark Office*